United States Patent [19]

Shively

[11] Patent Number: 4,854,908

[45] Date of Patent: Aug. 8, 1989

[54] STUFFED HORSE CONVERTIBLE TO UNICORN

[76] Inventor: Nina Shively, P.O. Box 136, South Kent, Conn. 06785

[21] Appl. No.: 104,778

[22] Filed: Oct. 5, 1987

[51] Int. Cl.[4] ..... A63H 3/16

[52] U.S. Cl. ..... 446/100; 446/372; 434/178; D21/165; D11/159

[58] Field of Search ..... 434/178, 156, 260; 446/27, 100, 327, 901, 98, 369, 372

[56] References Cited

U.S. PATENT DOCUMENTS

| | | | |
|---|---|---|---|
| 104,216 | 6/1870 | Sickles | 351/155 X |
| 1,239,982 | 9/1917 | Sweet | 446/100 |
| 1,330,089 | 2/1920 | Plauche | 446/98 X |
| 1,451,108 | 4/1923 | Post | 434/178 |
| 1,563,582 | 12/1925 | McDade | 434/178 |
| 2,275,956 | 3/1942 | Grace | 434/260 |
| 2,433,540 | 12/1947 | Wright | 434/178 X |
| 2,501,902 | 3/1950 | Howell | 434/260 |
| 2,538,085 | 1/1951 | Cotton | 434/178 |
| 2,708,809 | 5/1955 | Peterson | 446/100 |
| 3,546,788 | 12/1970 | Drum | 434/260 |
| 3,593,433 | 7/1971 | Dillon | 434/178 |
| 3,791,721 | 2/1974 | Helfrich | 351/156 X |
| 3,918,180 | 11/1975 | Chamberlin | 434/178 |
| 4,208,832 | 6/1980 | Corriveau | 446/100 |
| 4,642,054 | 2/1987 | Wada | 434/178 |
| 4,710,145 | 12/1987 | Hall Vandis | 446/100 |

FOREIGN PATENT DOCUMENTS

| | | | |
|---|---|---|---|
| 566160 | 9/1975 | Switzerland | 446/110 |
| 2013508 | 8/1979 | United Kingdom | 446/100 |

*Primary Examiner*—Robert E. Garrett
*Assistant Examiner*—Carl D. Price
*Attorney, Agent, or Firm*—Richard A. Craig

[57] ABSTRACT

A method of telling a story which involves changes of at least one of the identity, the mood and the circumstance of a fanciful main character is performed with the aid of a script, a model of the main character and accessory items wearable by the main character. In the performance of the method, the script is narrated, and while the script is being narrated, the accessory items worn by the main character are changed at appropriate times. The fanciful main character is a stuffed animal, specifically a horse. A first accessory item is a stuffed generally conical shaped horn the larger end of which is removably affixable to the forehead of the horse to convert the same to a unicorn, and a second accessory item is a pair of eyeglasses removably placeable on the horse.

1 Claim, 2 Drawing Sheets

STUFFED HORSE CONVERTIBLE TO UNICORN

BACKGROUND OF THE INVENTION

This invention relates to a method of telling a story and to physical items used in the telling of the story. More particularly, the story involves changes of at least one of the identity, the mood and the circumstance of a fanciful main character. These changes are depicted utilizing a model of the fanciful main character and accessory items which are wearable by the model and which are changed at appropriate times during the narration of the story.

No prior art is known which is pertinent to the patentability hereof.

The fanciful main character is a sympathetic character well suited to starring in any number of different stories. The stories may utilize common or different supporting characters, and some common and some different accessory items.

Important objects hereof are to provide a novel and unobvious method of telling a story and novel and unobvious physical items utilized therein.

Other objects and advantages will appear hereinafter.

SUMMARY OF THE INVENTION

The inventive method of telling a story involves changes of at least one of the identity, the mood and the circumstance of a fanciful main character and is performed with the aid of a script, a model of the main character, and accessory items which are wearable by the main character. In performing the method, the script is narrated aloud, and while the script is being narrated, the accessory items worn by the main character are changed at appropriate times. More particularly, the fanciful main character is a stuffed animal, specifically a horse. A first accessory item is a stuffed generally conically shaped horn the larger end of which is removably affixable to the forehead of the horse to convert the horse to a unicorn, and a second accessory item is a pair of eyeglasses removably placeable on the horse.

DESCRIPTION OF THE INVENTION

Figure 1:
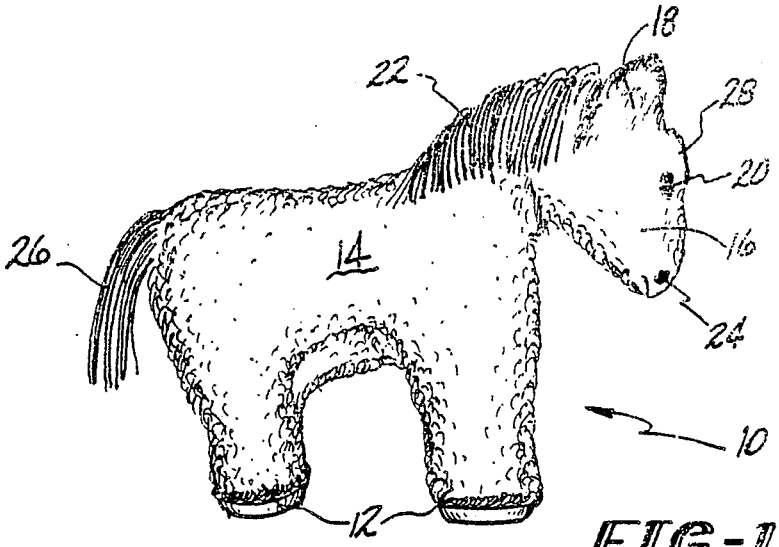
FIG. 1 is a side view of a model of a fanciful main character in a story, the main character being in the form of a stuffed horse, wearing no accessories.

FIG. 1 shows in side view a model of a fanciful main character in a story. The main character is in the form of a stuffed horse or pony 10, wearing no accessories, so therefore he is merely a horse or pony, having legs 12, a body 14, a head 16, ears 18, eyes 20, a mane 22, a nose 24, a tail 26 and a forehead 28 which is partly obscured by mane 22. He also has a name. It is Sir Whitney, of which more later.

Figure 2:
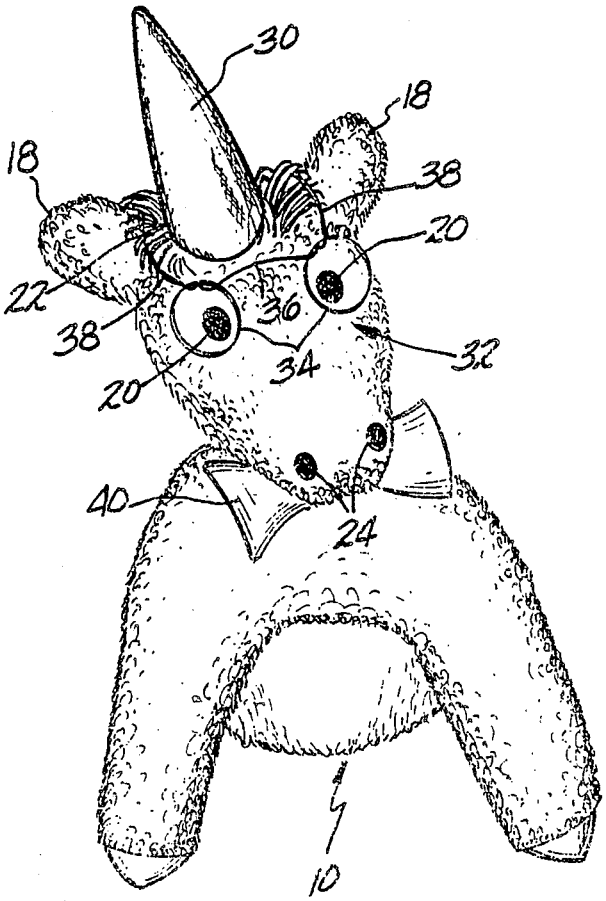
FIG. 2 is an enlarged full face view of the stuffed horse of FIG. 1, the horse wearing accessory items, namely, a horn, a pair of eyeglasses and a necktie, the horn converting the horse to a unicorn.

FIG. 2 illustrates horse 10 after conversion to a unicorn by the addition of a stuffed horn 30. A pair of eyeglasses 32 has also been added, in the form of a single piece of wire having loops 34 for surrounding eyes 20. Loops 34 are joined by a bridge piece 36 and temples 38 extend rearwardly from loops 34 to hook over ears 18. A bow tie 40 has also been added.

Figure 3:
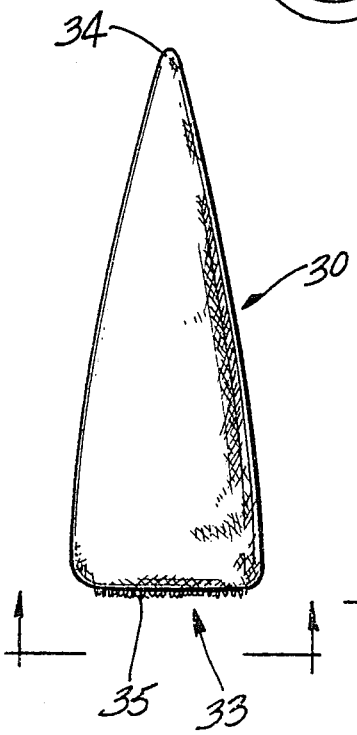
FIG. 3 is an elevation of the horn of FIG. 2.
Figure 4:
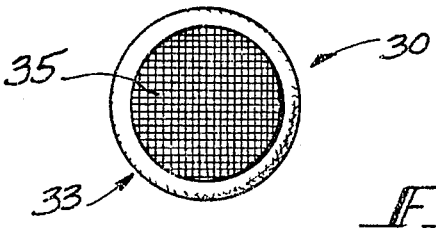
FIG. 4 is an end view of the horn of FIG. 3 as seen from line 4—4 of FIG. 3.

Horn 30 is also shown in FIGS. 3 and 4. It is generally conically shaped, tapering from a large diameter end 33 substantially to a point 34 at the other end. End 33 is removably affixable to forehead 28 to convert horse or pony 10 to a magical unicorn. More particularly, forehead 28 and end 33 of horn 30 are provided with mating hook and loop type fastening elements for almost instantaneously removably affixing horn 30 to forehead 28. One of these fastening elements is indicated at 35 on end 33, and the other of these fastening elements is not shown.

Figure 5:
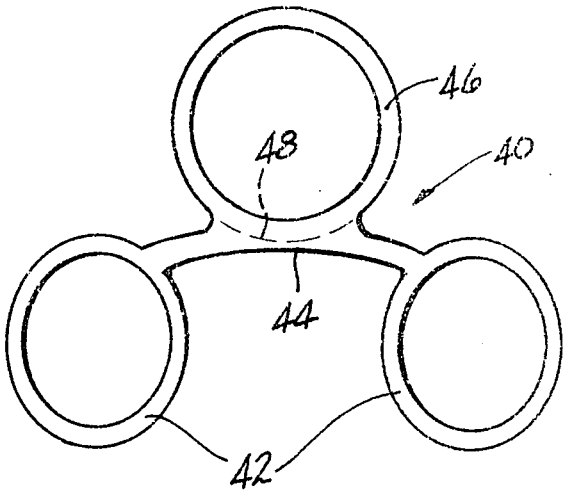
FIG. 5 is an elevation of a pair of eyeglasses.

FIG. 5 illustrates a pair of eyeglasses 40 which can be used alternatively to eyeglasses 32. Eyeglasses 40 are of one piece construction, having two loops or rings 42 for surrounding eyes 20. Loops 42 are joined by a web 44, integral with which is a third loop or ring 46. Loop 46 is somewhat bendable about a fold line 48 out of the plane of loops 42. Loop 46 provides a hole sized to receive horn 30, more particularly large diameter end 32 to hold eyeglasses 40 in place on horse 10.

A script telling a story involving changes of identity, mood and circumstance of Sir Whitney, a fanciful main character, will now be reproduced. At the start of the story, Sir Whitney is as shown in FIG. 1, devoid of accessories. He is simply horse 10. The script, which speaks for itself, follows:

"Hi! My name is Sir Whitney. I'm a horse and my colors are all mixed up."

"My legs are brown and white striped which makes me look like I am wearing shorts and leg warmers."

"Everyone laughs at me because I look so funny. Everyone, that is, except Jeannie."

Jeannie was Sir Whitney's friend who put glasses on him because he always bumped his nose when he went to his feed bucket.

(At this point, eyeglasses 34 may be slipped onto Sir Whitney, in the manner aforesaid.)

One day, Sir Whitney decided to trot to his favorite field to smell the daisies. "This spot looks comfy," he snorted as he sat down. "Eeeeeouch!jumpin' caterpillars!!! what was that?" Hollered Sir Whitney real loudly.

"Great grumbles, can't anyone get any sleep around here?" squinted Sadie, the groundhog. "What did-'ya do to my Hornicorn?"

(Sadie refers to horn 30.)

"Hornicorn? Is that what I sat on? It sure is sharp," whinnied Sir Whitney, "Wherever did you find it?"

"It fell on my head when I was digging out my bedroom," yawned Sadie. "It must have been buried a real long time."

"Oh! I've always wondered what it would be like to be a unicorn! May I put it on my head, Sadie . . . pleeeeease!" pleaded Sir Whitney.

"Alright, alright," Sadie said sleepily, "Just be quiet so I can get back to my nap."

(Here, horn 30 is placed on Sir Whitney's forehead 28, pushing mane 22 out of the way if necessary.)

As Sir Whitney put the Hornicorn on, he thought about getting a cool drink of water. Ker-splookity-spalsh!! All of a sudden he was standing in the middle of a pond!

"What . . . where am I?" blinked Sir Whitney.

"You're standing in my home, sir." frowned Pierre the frog. He was squished between his lilly pad and Sir Whitney's belly, and was not very happy about it!

"How did I get here?" Asked Sir Whitney. "I don't know, but I do wish you'd get off my head," croaked Pierre.

"Oh dear, oh my! What will become of me? I don't know where I am, and it's getting dark. How will I get home?" said Sir Whitney as he began to cry.

Meanwhile, back in the barn, Jeannie and Professor Hoot, the owl, were worried. Sir Whitney hadn't returned from his trot. "Perhaps I should fly around and see if I can find him! Maybe he dropped his glasses and got lost," said the owl. He flapped his wings and out of the barn he flew. Professor Hoot was circling the pond when he saw something glistening below. Screeech," he yowled as he swooped down towards it. Flapping his wings wildly, he came to a stop next to the hornicorn, and discovered he was sitting on Sir Whitney's nose. "What's this? The Magical Hornicorn? Who does this belong to?" whistled Professor Hoot.

"It's Sadie's, and I guess I'd better give it back, huh?" pouted Sir Whitney.

"Yes, you should. And if you ever borrow it again, remember it's magical. You will go to any place you think about, so be careful or you could get into trouble," warned the Professor.

"I will be careful, I promise, I promise!" said Sir Whitney, shaking and shivering.

He galloped back to Sadie's, and after he placed the Hornicorn back into her hole, he said, "Can we please go home now, Mr. Owl?"

With Professor Hoot sitting on Sir Whitney's head, they trotted home to Jeannie.

Sir Whitney was ready for a nap, and he knew that he would dream about the Magical Hornicorn.

"Next time," thought Sir Whitney with a smile, "Maybe I'll go to the moon!"

The supporting characters, such as Jeannie, Sadie, Pierre and Professor Hoot can also be provided in the form of stuffed animals.

It is evident that the invention attains the stated objects and advantages and others.

The disclosed details are not to be taken as limitations on the invention except as those details are included in the appended claims.

What is claimed is:

1. The combination of a stuffed horse and an accessory item therefor in the form of a stuffed generally conically shaped horn having a large diameter end removably affixable superficially to the forehead of the horse to convert the horse to a unicorn, the forehead of the horse and the large diameter end of the horn being provided with mating hook and loop type fastening elements for removably affixing said horn to the forehead of said horse, the combination further comprising a pair of eyeglasses removably placeable on the horse, said eyeglasses having a hole therethrough which is sized to receive said large diameter end of said horn to permit engagement of said fastening elements through said hole to hold said pair of eyeglasses in place on said horse.

* * * * *